US011447219B2

(12) United States Patent
Paulic et al.

(10) Patent No.: US 11,447,219 B2
(45) **Date of Patent: *Sep. 20, 2022**

(54) WEAPONIZED UUV WITH FLOATING BARREL AND EXTERNALLY ACCESSIBLE BREECH

(71) Applicant: Advanced Acoustic Concepts, LLC, Washington, DC (US)

(72) Inventors: Antonio Paulic, Westerville, OH (US); Terry Miller, Washington, DC (US)

(73) Assignee: Advanced Acoustic Concepts, LLC, Hauppauge, NY (US)

( * ) Notice: Subject to any disclaimer, the term of this patent is extended or adjusted under 35 U.S.C. 154(b) by 345 days.

This patent is subject to a terminal disclaimer.

(21) Appl. No.: 16/746,620

(22) Filed: Jan. 17, 2020

(65) Prior Publication Data

US 2021/0276681 A1 Sep. 9, 2021

Related U.S. Application Data

(60) Provisional application No. 62/794,410, filed on Jan. 18, 2019.

(51) Int. Cl.

| | |
|---|---|
| ***B63G 9/00*** | (2006.01) |
| ***B63G 8/00*** | (2006.01) |
| ***F41A 25/06*** | (2006.01) |

(52) U.S. Cl.

CPC ..... *B63G 9/00* (2013.01); *B63G 8/001* (2013.01); *F41A 25/06* (2013.01)

(58) Field of Classification Search

CPC .... B63G 8/001; B63G 8/30; B63G 2008/002; B63G 9/00; F41A 23/22; F41A 25/06; F41A 25/08; F41A 25/22

USPC ..... 89/14.3, 37.06, 37.14; 114/316, 320

See application file for complete search history.

(56) References Cited

U.S. PATENT DOCUMENTS

| | | | | |
|---|---|---|---|---|
| 1,303,266 | A * | 5/1919 | Dougan | B63G 8/32 114/316 |
| 1,303,272 | A * | 5/1919 | Elia | F42B 22/10 114/316 |
| 4,854,260 | A * | 8/1989 | Woidich | F41F 3/07 114/316 |
| 5,363,791 | A * | 11/1994 | Stallard, III | B63G 8/28 114/238 |
| 6,848,386 | B1 * | 2/2005 | Gieseke | B63G 9/00 114/316 |
| 11,142,293 | B2 * | 10/2021 | Paulic | B63G 8/001 |
| 2009/0090286 | A1 * | 4/2009 | Korolenko | B63G 8/30 114/316 |
| 2009/0158990 | A1 * | 6/2009 | Owen | F41F 3/10 114/238 |
| 2010/0269679 | A1 * | 10/2010 | Fisk | F41A 25/08 89/37.11 |

* cited by examiner

*Primary Examiner* — Bret Hayes

(74) *Attorney, Agent, or Firm* — Kaplan Breyer Schwarz, LLP

(57) ABSTRACT

A weaponized UUV has a sliding barrel and accessible breech. The barrel slides in response to the firing of a projectile, and moves a first distance un-arrested, providing time for the projectile to clear the barrel. After the projectile clears the barrel, a recoil mechanism engages the barrel, transferring the recoil load to the hull of the UUV.

20 Claims, 4 Drawing Sheets

310
472
218
466
464
470
468
474
462

462
468
$D_1$
218

476
474
468
466
470
472
218
460

WEAPONIZED UUV WITH FLOATING BARREL AND EXTERNALLY ACCESSIBLE BREECH

STATEMENT OF RELATED CASES

This case claims priority of U.S. Pat. Appl. Ser. No. 62/794,410, filed Jan. 18, 2019 and which is incorporated herein by reference.

FIELD OF THE INVENTION

The present invention relates to a weapon for use with underwater vehicles.

BACKGROUND

Underwater-gun systems are being developed for naval warfare. These systems often use a propellant cartridge to launch a projectile from a launch tube.

A variety of challenges exist to the development of effective underwater guns, especially those being fired from an unmanned underwater vehicle (UUV). Some of such challenges include managing the recoil of the gun so that it does not damage the UUV or affect the trajectory of the projectile being fired from the gun.

SUMMARY

Embodiments of the invention provide a weaponized UUV that avoids some of the drawbacks of the prior art.

If the onboard weapon of a small UUV includes a rigidly mounted barrel, firing a projectile from the weapon will impart a large g-force to the UUV due to recoil. This recoil impulse can: (a) damage sensitive onboard equipment, and (b) destabilize the UUV. As to the latter, due to a rigidly mounted barrel, yaw and/or pitching motions will result due to the fluid dynamic drag of the vehicle while the projectile is still accelerating in the barrel. These motions will unpredictably alter the trajectory of the projectile.

In accordance with the present teachings, the barrel of a weapon on a weaponized UUV is configured to "float" or "slide" within the UUV, subject to the operation of a recoil mechanism. As the weapon is fired and a projectile accelerates toward the muzzle of the barrel, the barrel moves freely in a direction opposite to that of the projectile. By design, the recoil mechanism applies an arresting force to the barrel—and transfers recoil load to the UUV—but only after the projectile exits the barrel. Therefore, during the brief period of time that the projectile is in the barrel after firing, the barrel is thrown stably backwards in opposition to the propellant's force. As a consequence, any yaw or pitching motions that might otherwise occur due to firing the round are mitigated, at least until the projectile exits the barrel, assuring aim-point accuracy.

After the round exits the barrel, the barrel must come to rest, transferring a load to the UUV. For a small UUV, this load can be significant relative to the mass of the UUV, and poses a risk to sensitive onboard electronics/optics. In such cases, after the projectile exits the muzzle, the recoil mechanism decelerates the gun barrel while simultaneously accelerating the UUV. Once the recoil mechanism engages, the UUV will accelerate backward, away from the target (itself a benefit in terms of UUV survivability). In order to minimize the recoil load, the recoil mechanism is designed such that the final barrel velocity matches the UUV's speed. Thus, this approach leverages the UUV's motion to mitigate recoil load.

In some embodiments of applicant's weaponized UUV, the weapon's barrel is situated along the longitudinal central axis of the UUV. In some embodiments, the barrel exceeds the length of the UUV, such that both or one of: (1) the muzzle extends slightly beyond the nose of the UUV and (2) a portion of the breech extends beyond the tail of the UUV. The breech end includes a removable cap that advantageously enables the weapon to be reloaded without disassembling the UUV.

DETAILED DESCRIPTION

Figure 1:
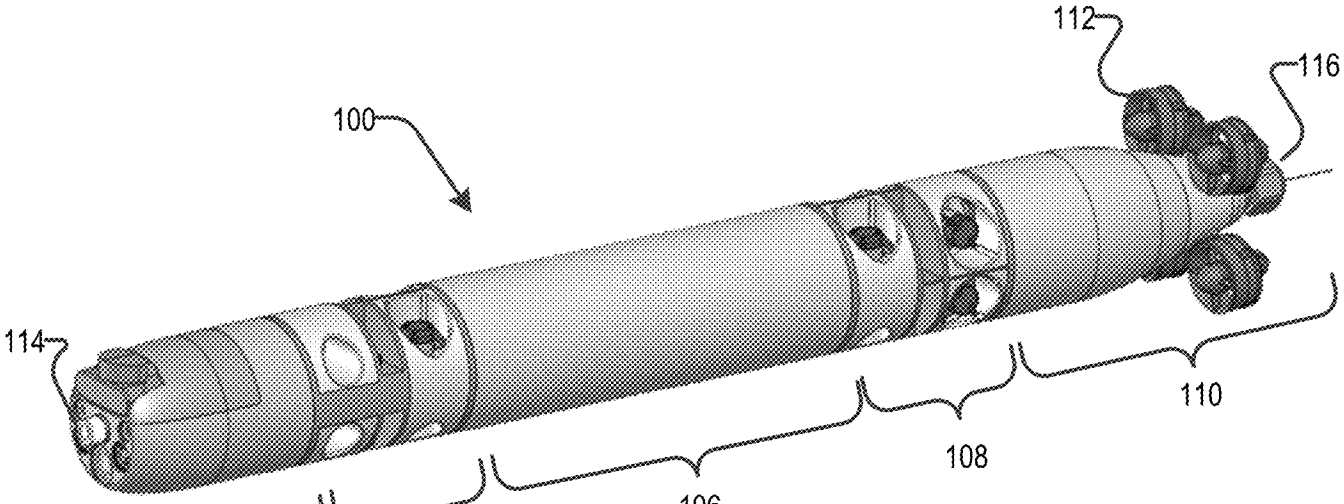
FIG. 1 depicts a weaponized UUV in accordance with the illustrative embodiment.
Figure 2:
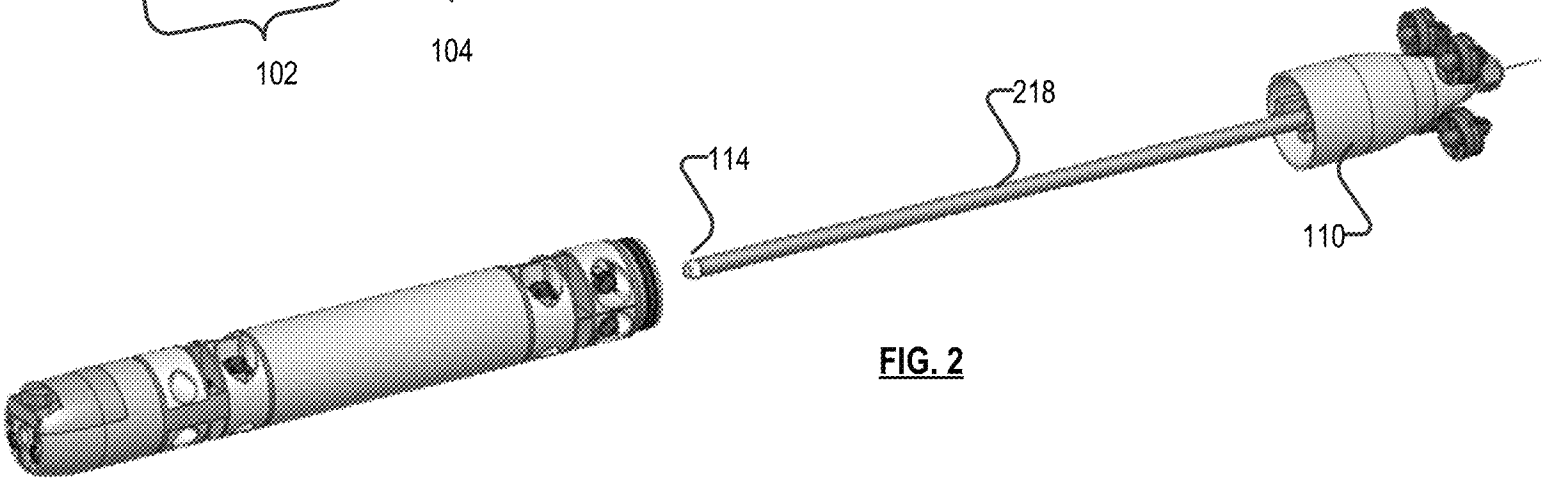
FIG. 2 depicts the weaponized UUV of FIG. 1 wherein the tail section is removed, exposing the gun barrel of the UUV.

FIGS. 1 and 2 depict weaponized UUV 100 having a sliding or "floating" barrel and accessible breech in accordance with the illustrative embodiment of the invention. UUV 100 includes nose section 102, forward cross-hull thruster section 104, electronics section 106, aft cross-hull-thruster section 108, and tail section 110.

Tail section 110 includes plural, externally mounted thrusters 112. In some other embodiments, the tail thrusters are internally sited or otherwise shrouded. UUV 100 is weaponized and, in the illustrative embodiment, includes a weapon that is situated along the longitudinal central axis of the UUV. In the illustrative embodiment, the weapon comprises barrel 218, which exceeds the length of the hull of UUV 100. As depicted in FIG. 1, muzzle 114 (shown with a muzzle cap in FIGS. 1 and 2) protrudes from nose section 102 of UUV 100 and breech cap 116 protrudes from tail section 110.

In the illustrative embodiment, nose section 102 contains one or more of video, sonar, lasers, and LEDs. Electronics section 106 contains power supply (e.g., batteries, etc.), control electronics, and the like. Thruster sections 104 and 108 contain thrusters and supporting electronics/mechanics. Because the electrical, optical, and mechanical elements of nose section 102, electronics section 106, and thruster sections 104 and 108 are not germane to the invention, they will not be described herein. Tail section 110 includes a recoil mechanism, described in detail in conjunction with FIGS. 4A-4C and 5A-5C, for transferring the force of recoil from barrel 218 to the hull of UUV 100.

Figure 3A:
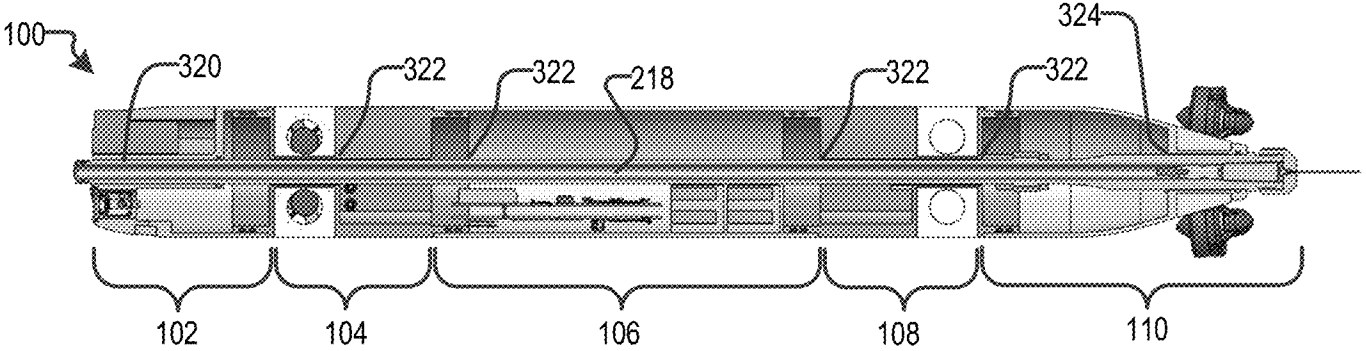
FIG. 3A depicts a side cross-sectional view of the weaponized UUV of FIG. 1.

FIG. 3A depicts a side cross-sectional view of an embodiment of weaponized UUV 100. As depicted in this Figure, barrel 218 aligns with the longitudinal central axis of UUV 100. The barrel, which in the illustrative embodiment is a 20 millimeter (mm) "cannon," is made from high-strength steel, titanium, or the like. For embodiments in which the weaponized UUV is relatively small and hence weight-limited, titanium is preferred, as a consequence of its light weight. High-strength steel is, however, a more affordable option, and is suitably used if weight is not of particular concern.

To manage the recoil that results when the weapon is fired, UUV 100 is configured so that barrel 218 freely slides or "floats" some distance through the UUV, in a direction opposite to that in which the projectile moves. It is important that water does not enter the UUV during this sliding movement. To that end, water-tight seals are positioned around barrel 218 in nose section 102 and tail section 110, as discussed further below with respect to FIGS. 3B and 3C.

Figure 3B:
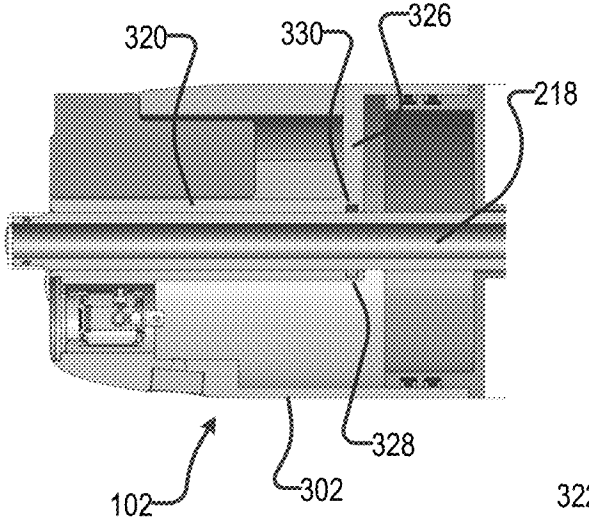
FIG. 3B depicts a side cross-sectional view of the nose section of the weaponized UUV of FIG. 1.

Referring now to FIG. 3B, tube 320 is provided in nose section 102. Tube 320 is supported by member 326, which couples the tube to hull 302 of nose section 102. Tube 320 provides support for barrel 218 in nose section 102 and, as discussed below, is part of the sealing arrangement for preventing water intrusion into UUV 100.

Annular seal groove 328 is disposed at the aft end of tube 320. The seal groove receives annular nose seal 330. This seal, known as a "piston seal," is a commercial off-the-shelf product, available from suppliers such as Parker Hannifin of Cleveland, Ohio. This type of seal is typically used in high-pressure hydraulic systems, wherein a hydraulic piston moves in reciprocating motion. To ensure that the seal formed by nose seal 330 remains water-tight, particularly if the UUV is operating at relatively significant depths such that the water pressure is quite high, any portion of the exterior surface of barrel 218 that may contact nose seal 330 must meet stringent tolerances in terms of diameter and roughness. In particular, in some such embodiments, nose seal 330 and the relevant portion of the exterior of barrel 218, are made to tolerances sufficient for establishing a sealing pressure of up to about 10,000 psi. Consequently, the exterior portion of barrel 218 extending from muzzle 114 to the location of annular seal 330 must be machined or otherwise treated, thereby forming a "forward sealing surface" of barrel 218.

Figure 3C:
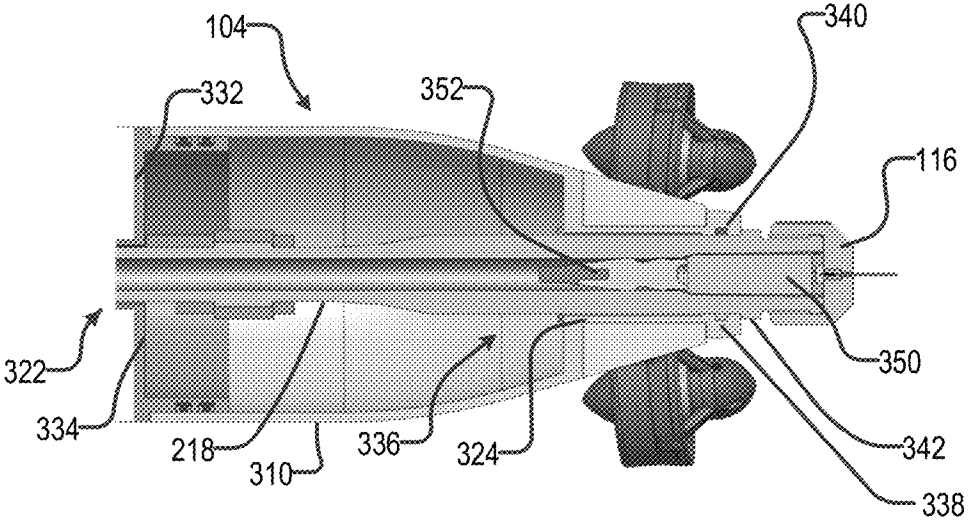
FIG. 3C depicts a side cross-sectional view of the tail section of the weaponized UUV of FIG. 1.

Referring now to FIG. 3C, tube 324 is provided in tail section 110. In the illustrative embodiment, tube is formed as the aft-most portion of hull 310, extending beyond wall 311. Tube 324 provides support for breech 336 and forms part of the sealing arrangement for preventing water intrusion.

Annular seal groove 338 is disposed proximal to aft end of breech 336. Annular seal groove 338 receives tail seal 340. This seal is the same type of seal (i.e., piston seal) as nose seal 330. Like the forward portion of barrel 218, any portion of the exterior surface of breech 336 that may contact tail seal 340 must meet stringent tolerances in terms of diameter and roughness, and forms an "aft sealing surface" of breech 336.

As discussed later herein, embodiments of weaponized UUV 100 will be designed for a specified amount of barrel travel during recoil. That amount of travel (e.g., 7 inches for a 30-inch barrel, etc.) determines the length of the forward sealing surface and the length of the aft sealing surface; that is, each would be about 7 inches in length.

Since barrel 218 exceeds the length of UUV 100, there may be internal structures that would obstruct the barrel in the absence of specific accommodations. To that end, such internal structures must include openings to enable the barrel to pass completely through the UUV. Consequently, in addition to tube 320 in nose section 102 and tube 324 in tail section 110, UUV 100 includes barrel-passage openings 322 in forward cross-hull thruster section 104, electronics compartment 106, and aft cross-hull-thruster section 108. All such openings and tubes align providing an unobstructed path through the hull so that barrel 218 can pass from tail to nose. In the illustrative embodiment, the openings and tubes align with the longitudinal central axis of UUV 100. In addition to enabling barrel 218 to pass through UUV 100, the aforementioned openings and tubes support barrel 218 for stable translational movement, as described further in conjunction with FIGS. 4A-4C and 5A-5C.

The current industry-standard in UUV design is the development of UUV segments or kits that easily couple (e.g., snap, etc.) together. UUVs are designed to be modular so that alternative segments or kits can be readily exchanged to alter the configuration of a UUV.

Embodiments of weaponized UUVs disclosed herein use the aforementioned segmental approach (i.e., nose section 102, forward cross-hull thruster section 104, electronics compartment 106, aft cross-hull-thruster section 108, and tail section 110). In fact, in some other embodiments, one or more of sections 104, 106, and 108 are replaced by other sections having other functionality. And in yet some further embodiments, one or more additional sections having functionality other than that possessed by sections 104, 106, and 108 are added to the sections of UUV 100 depicted in FIG. 3A. To accommodate both industry-standard modularity and UUV-spanning barrel 218, each and every section of a UUV in accordance with the present teachings will incorporate aspects of the standard design practice, and also include one or more openings that align with one another. This additionally applied to any replacement sections that may replace any of sections 104, 106, or 108, or any sections that may supplement these sections.

It is notable that a portion of breech 336 protrudes from the hull of UUV 100, and includes removable breech cap 116 (see, e.g., FIGS. 1, 3C, etc.) The removable breech cap permits the UUV's weapon to be reloaded without disassembling the UUV.

When a projectile is fired from a free-to-slide barrel, such as barrel 218, the barrel will quickly accelerate in a direction opposite to that of the projectile due to the force of recoil. If the barrel's movement is not moderated, when it does come to a hard stop, the impulse transmitted to the UUV might result in damage to sensitive components therein. Embodiments in accordance with the present teachings therefore include some provision for moderating the transfer of recoil force to UUV 100.

Figures 4A, 4B, 4C:
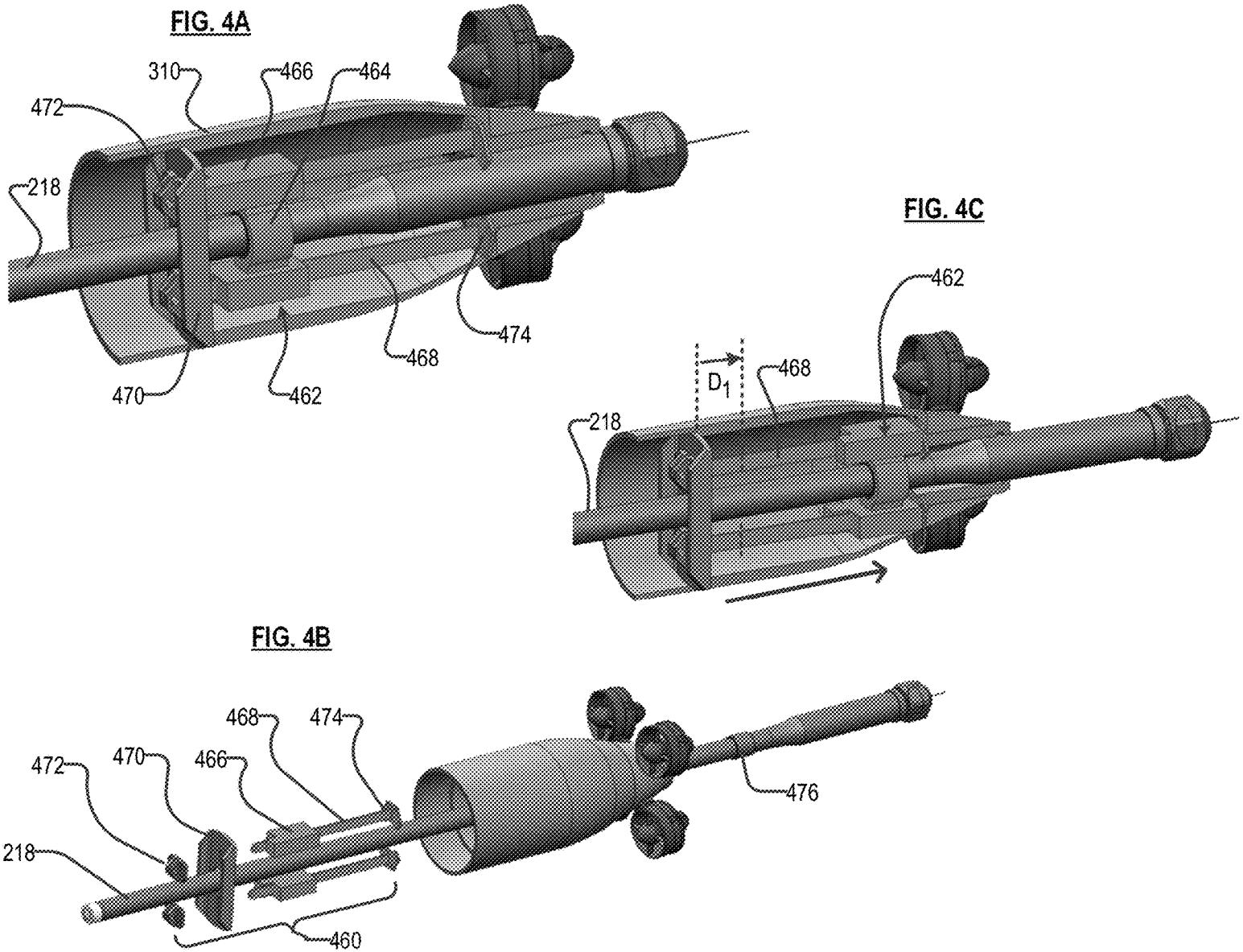
FIG. 4A depicts a perspective view of the tail section of the weaponized UUV of FIG. 1, showing details of the recoil mechanism, and wherein the recoil mechanism is in a pre-fire state.
FIG. 4B depicts an exploded view of the recoil mechanism.
FIG. 4C depicts the tail section of FIG. 4A, wherein the recoil mechanism is in a post-fire state.

FIGS. 4A and 4B depict respective assembled and exploded perspective views of recoil mechanism 460 that transfers the force of recoil from barrel 218 to UUV 100. The recoil mechanism is designed to effect this transfer in a controlled manner that avoids damaging sensitive components/internals of UUV 100, and also avoids imparting pitching or yawing motions that would affect the trajectory of projectile 352.

In the illustrative embodiment, recoil mechanism 460 is a single direction, automatic-clutching friction damper, which is available from Sten-Tek Corp. of St. Petersburg, Fla. Recoil mechanism 460 resists sliding in a first direction, while enabling sliding in the opposite direction. In the illustrative embodiment, the sliding resistance is adjustable and pre-settable.

In some embodiments, the engagement of recoil mechanism 460 is delayed; that is, the recoil mechanism doesn't affect the movement of barrel 218 (i.e., recoil) until it has travelled a specified distance. In some other embodiments, recoil mechanism 460 engages substantially immediately upon recoil of barrel 218. In some embodiments, the sliding resistance is substantially constant with displacement of barrel 218 whereas in other embodiments, the sliding resistance is variable. In some additional embodiments, the sliding resistance is controllable with barrel displacement.

As depicted in FIGS. 4A and 4B, recoil mechanism 460 includes recoil carriage 462, slide bars 468, recoil bracket 470, and slide-bar footers 474. Recoil bracket 470 is coupled, via pin joints 472, to slide bars 468. Additionally, recoil bracket 470 physically couples to hull 310 of tail section 110. In some embodiments, recoil bracket 470 is attached to the hull via fasteners (coupling to appropriate coupling features extending from the hull). In some other embodiments, the recoil bracket is welded to the hull. Slide bars 468 are fixed, via slide-bar footers 474, to hull 310. Barrel 218 passes through an opening in recoil bracket 470.

In the illustrative embodiment, recoil carriage 462 includes clutches 466 and coupling ring 464. Recoil cartridge 462 couples to barrel 218 via threaded interface 476 (see, FIG. 4B). More particularly, threads disposed on the inner surface of coupling ring 464 engage the external threads of threaded interface 476, thereby coupling the coupling ring (and by extension, recoil carriage 462) to the threaded interface (and by extension, barrel 218). Consequently, barrel 218 and recoil carriage 462 move in concert. Recoil carriage 462 also couples to slide bars 468 and, subject to the operation of recoil mechanism 460, is movable along the slide bars.

It is notable that threaded interface 476 enables barrel 218 to be installed into and removed from recoil mechanism 460 without breaking apart any of the UUV's sections. In other words, recoil mechanism 460 can remain in UUV 100 and barrel 218 is simply threaded into or out of coupling ring 476 as required.

In the illustrative embodiment, recoil mechanism 460 operates as follows. Before the weapon fires, recoil carriage 462 is positioned as depicted in FIG. 4A. As the weapon fires, and, by design, for as long as projectile 352 is within barrel 218, the barrel slides aft freely, unimpeded by recoil mechanism 460. The recoil mechanism is adjusted to accomplish this, providing a predetermined amount of displacement in which barrel 218 and recoil carriage 462 slide, without resistance, opposite to the direction in which the projectile is moving.

The predetermined amount of displacement $D_1$, depicted in FIG. 4C, is calculated to provide sufficient time for projectile 352 to exit barrel 218. This distance is readily calculated based on the projectile's muzzle velocity, the length of barrel 218, and the unimpeded velocity of the barrel. During this limited amount of unimpeded movement, the force of recoil is not imparted to UUV 100. As such, yawing or pitching motions (that would otherwise be induced in the UUV) and that affect the accuracy of targeting, are avoided.

After sliding for predetermined distance $D_1$, recoil mechanism 460 engages. Specifically, clutches 466 of recoil carriage 462 grip slide bars 468 with a predetermined amount of force. At this point, the recoil force, up to the amount of force with which clutches 466 grip slide bars 468, will be transmitted through the slide bars to recoil bracket 470, and, in turn, to hull 310 of tail section 110 of UUV 100.

As the recoil load is transferred to UUV 100, it will move "backwards;" that is, in the direction opposite to that which the projectile is traveling. To the extent the recoil force exceeds the grip that clutches 466 apply to slide bars 468, recoil carriage 462, with barrel 218 attached, will slide aft along the bars (see, FIG. 4C). Recoil bracket 470 and, ultimately, hull 310, will continue receiving the recoil force, up to the amount of the gripping force, as recoil carriage 462 and barrel 218 slide aft. As the recoil force is transferred, recoil carriage 462 and barrel 218 will continue to slow and ultimately come to rest near the back of tail section 110, as depicted in FIG. 4C.

Based on a number of factors, including the mass of the projectile, the muzzle velocity of the projectile, the mass of the barrel, and the mass of the overall vehicle, the recoil mechanism is adjusted to provide an amount of resistance that will simultaneously satisfy the (competing) requirements of: (i) minimizing shock to the UUV, and (ii) minimizing the relative stroke (movement) of the barrel. Requirement (ii) implicates the space constraints in embodiments in which UUV is small (e.g., less than 5 feet in length).

Figure 5A:
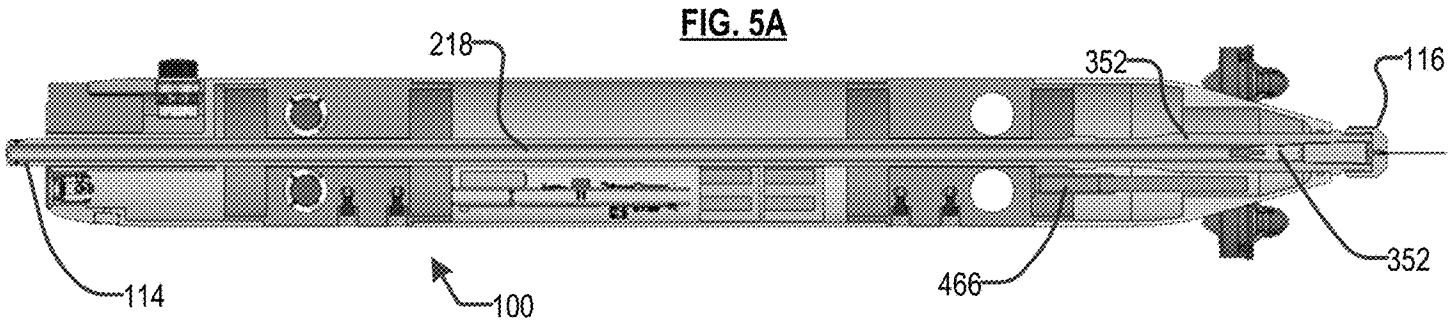
FIGS. 5A-5C depict, via a sequence of side cross-sectional views, movement of the barrel and recoil mechanism in response to firing a projectile from the UUV's weapon.
Figure 5B:
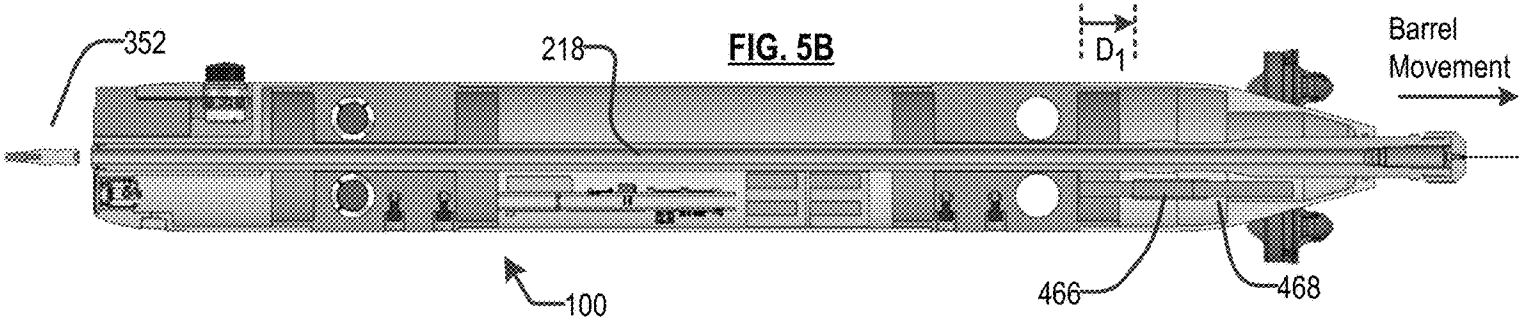
Figure 5C:
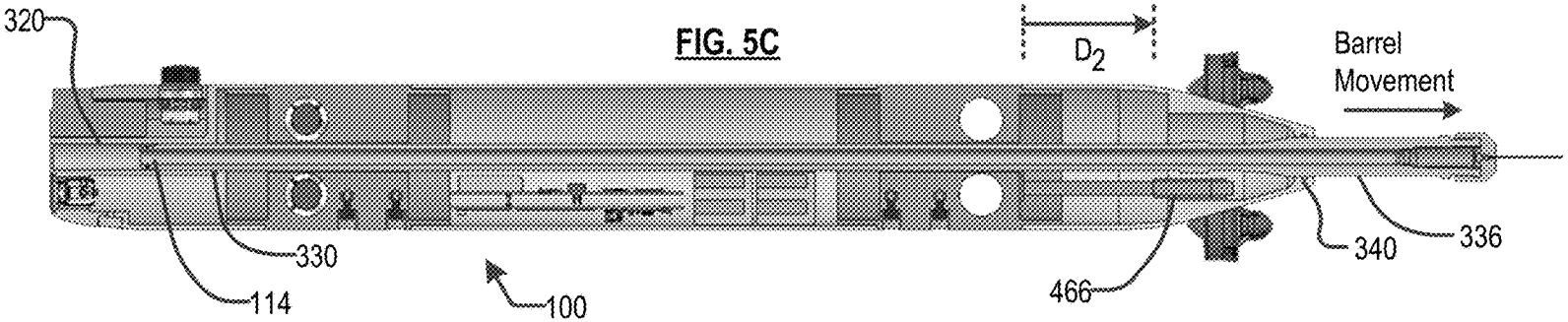

The recoil of barrel 218 and the operation of recoil mechanism 460 is further depicted in FIGS. 5A through 5C.

In FIG. 5A, barrel 218 and the recoil carriage (only one of clutches 466 is shown for clarity) is in a pre-fire state, with projectile 352 in breech 336. Muzzle 114 extends from the nose of UUV 100 and breech cap 116 extends from its tail.

In FIG. 5B, projectile 352 has just exited barrel 218. Up to this point, the barrel has moved backwards freely for the distance $D_1$, imparting no force to UUV 100 that would otherwise cause yawing or pitching motions. Immediately after the projectile leaves the barrel, clutches 466 engages slides 468 and begin transferring the recoil load to UUV 100.

Assuming that UUV 100 is moving in a direction opposite to that of projectile 352 (or is initially quiescent), as the recoil carriage and barrel slide aft, they are, by definition, moving faster than UUV 100. The recoil carriage and barrel will continue to slow as recoil force is transferred to the UUV. Meanwhile, UUV 100 continues to accelerate backwards, its velocity in that direction increasing. Referring to FIG. 5C, by the time the recoil carriage and barrel 218 are about to come to a stop as imposed by internals of tail section 110, and having moved a distance $D_2$, the relative speeds of UUV 100 and the recoil carriage/barrel should be close to zero. This helps to ensure that any sensitive electronics onboard the UUV will not be affected by the recoil of barrel 218.

It is notable that as barrel 218 recoils, muzzle 114 moves into nose section 102, sliding aft through tube 320. However, some portion of barrel 218 remains within tube 320 and, importantly, forward of nose seal 330. Thus, some portion of the forward sealing surface on the exterior of the forward portion of barrel 218 is in contact with nose seal 330. Similarly, although a substantial portion of breech 336 has moved out of tail section 110, some portion of the aft sealing surface on the exterior of breech 336 is in contact with tail seal 340.

Example. By way of the illustration not limitation, consider an embodiment in which:

| | |
|---|---|
| Weight of UUV 100: | 150 pounds |
| Weight of barrel 218: | 26 pounds |
| Length of barrel 218: | 82 inches |
| Weight of projectile 352: | 100 grams |
| Muzzle speed of projectile 352: | 3,300 ft/sec |

With UUV 100 quiescent (not moving), the weapon fires. Barrel 218 recoils in response, reaching its peak velocity (in excess of 100 feet per second) in about 2 milliseconds. In about that amount of time, projectile 352 exits the barrel, the barrel having recoiled predetermined distance $D_1$ (c.a. about 1.5 inches). Having traveled the predetermined distance, recoil mechanism 460 engages (i.e., clutches 466 gripping slide bars 468), applying a constant retarding load of about 400 lbf. As the mechanism engages, UUV 100 begins to move backwards and barrel 218 begins slowing. In less than about 50 milliseconds, the relative speed between UUV 100 and barrel 218 is close to zero, and recoil carriage 460 has come to a gentle stop within the UUV. Barrel 218 has travelled aft a total distance $D_2$ of about 7 inches.

Referring again to FIGS. 2 and 3A, barrel 218 is typically installed in UUV 100 as one of the final assembly operations. The muzzle cap, as required for underwater operation, is physically adapted to fit within tube 320 of nose section 102. This enables the muzzle cap to be installed through opening 324 in tail section 110. As such, the muzzle cap can be installed either before or after the barrel is inserted into UUV 100.

Thus, in some assembly methods, the barrel's muzzle 114 is inserted into opening 324 in tail section 110 of UUV 100 and pushed through the various barrel passage openings 322, ultimately entering tube 320 in nose section 102. Once muzzle 114 reaches tube 320, barrel 218 is secured to recoil mechanism 460 by screwing threaded interface 476 into coupling ring 464 (see, e.g., FIGS. 4A, 4B).

Protrusion 342 on barrel 218 (FIG. 3C) functions as a "hard stop," ensuring that the barrel cannot be inserted too far into UUV 100. Protrusion 342 also provides an alignment reference to ensure that barrel 218 is positioned correctly before firing a projectile. After a projectile is fired, barrel 218 is reloaded by removing breech cap 116 and replacing the spent propellant cartridge with a new projectile and a new propellant cartridge.

An alternative assembly method is to assemble barrel 218 into tail section 110 and then insert/slide the entire tail section, with the barrel attached, through the rest of the UUV, which has already been assembled. It is possible that barrel 218 could be jammed in recoil mechanism 460, thereby preventing its removal from tail section 110. In such a situation, the entire tail section can be removed from the vehicle, enabling the barrel and recoil mechanism to be serviced.

It is to be understood that the disclosure describes a few embodiments and that many variations of the invention can easily be devised by those skilled in the art after reading this disclosure and that the scope of the present invention is to be determined by the following claims.

What is claimed:

1. A weaponized unmanned underwater vehicle (UUV) for firing a projectile, the weaponized UUV comprising:

a barrel having a muzzle and a breech;

a hull, wherein the barrel is longer than the hull, and further wherein the hull comprises at least one physical adaptation that enables the barrel to pass therethrough along a first longitudinal axis thereof, so that the muzzle is situated proximal to a nose of the weaponized UUV and a portion of the breech extends aft of a tail of the weaponized UUV, and wherein the barrel is slidable within the hull along the first longitudinal axis, and a recoil mechanism, wherein the recoil mechanism couples to the barrel and to the hull, wherein the recoil mechanism arrests movement of the barrel when a projectile is fired therefrom by transferring recoil load to the hull.

2. The weaponized UUV of claim 1, wherein the first longitudinal axis aligns with a longitudinal centerline of the weaponized UUV.

3. The weaponized UUV of claim 1, wherein the physical adaptation is an unobstructed pathway through the hull along the first longitudinal axis thereof, the pathway being suitably dimensioned and arranged to accommodate the barrel.

4. The weaponized UUV of claim 3, wherein the unobstructed pathway comprises a plurality of openings through structures within the hull of the weaponized UUV, wherein the openings are co-linear to permit the barrel to be situated in the hull and extend between the nose and the tail of the weaponized UUV.

5. The weaponized UUV of claim 3, wherein the hull comprises a first plurality of hull sections, at least some of which hull sections, based on structures disposed therein, have a differing functionality associated therewith than other of the hull sections, the hull sections being replaceable by one or more hull sections of a second plurality, such replacement hull sections capable of altering a functionality of the weaponized UUV, wherein each hull section of the second plurality is physically adapted to provide the obstructed pathway therethrough.

6. The weaponized UUV of claim 1 and further comprising a breech cap, wherein the breech cap seals the breech, and wherein the breech cap is removed to reload the weaponized UUV without disassembling same.

7. The weaponized UUV of claim 1, wherein the recoil mechanism is physically adapted to permit the barrel to recoil a first distance without arresting movement thereof, wherein the first distance is calculated based on a time required for the projectile to clear the barrel.

8. The weaponized UUV of claim 7, wherein, after the barrel recoils the first distance, the recoil mechanism is physically configured to engage, thereby arresting movement of the barrel.

9. The weaponized UUV of claim 1, wherein the recoil mechanism is an automatic-clutching friction damper.

10. The weaponized UUV of claim 1 wherein recoil mechanism comprises a stationary portion and a movable portion, the movable portion being a recoil carriage comprising a coupling ring, the coupling ring having internal screw threads that couple to external screw threads of a threaded interface that is disposed on an exterior of the barrel, the coupling ring and the threaded interface thereby enabling the barrel to be coupled to or decoupled from the recoil mechanism without disassembling the UUV.

11. A weaponized unmanned underwater vehicle (UUV) for firing a projectile, the weaponized UUV comprising:

a barrel having a muzzle and a breech;

a hull, wherein the barrel is longer than the hull, and wherein:

(a) the muzzle extends forward of the nose of the weaponized UUV, and (b) a portion of the breech extends aft of a tail of the weaponized UUV, and wherein the barrel is disposed within the hull along a longitudinal centerline thereof, and wherein the barrel is slidable within the hull; and a recoil mechanism, wherein the recoil mechanism couples to the barrel and to the hull, wherein the recoil mechanism arrests movement of the barrel when a projectile is fired therefrom by transferring recoil load to the hull.

12. The weaponized UUV of claim 11, and further comprising a tube disposed in the hull along the longitudinal centerline, wherein the tube receives a portion of the barrel proximal to the muzzle, the tube including a nose seal, and wherein an external surface of at least a portion of the barrel that resides in the tube is treated to form a forward sealing surface, wherein, contact between the nose seal and the forward sealing surface establishes a seal that prevents water from entering the weaponized UUV through the tube.

13. The weaponized UUV of claim 11, and further comprising a tube proximal to the tail of the weaponized UUV and extending from the hull along the longitudinal centerline, wherein the tube receives a portion of the breech, the tube including a tail seal, and wherein an external surface of at least a portion of the breech that resides in the tube is treated to form a aft sealing surface, wherein, contact between the tail seal and the aft sealing surface establishes a seal that prevents water from entering the weaponized UUV through the tube.

14. The weaponized UUV of claim 11, wherein the recoil mechanism is physically adapted to permit the barrel to recoil a first distance without arresting movement thereof, wherein the first distance is calculated based on a time required for the projectile to clear the barrel.

15. The weaponized UUV of claim 14, wherein, after the barrel recoils the first distance, the recoil mechanism is physically configured to engage, thereby arresting movement of the barrel.

16. The weaponized UUV of claim 11, wherein the recoil mechanism is an automatic-clutching friction damper.

17. A weaponized unmanned underwater vehicle (UUV) for firing a projectile, the weaponized UUV comprising:

a hull, the hull having a nose and a tail, and the hull containing internal functional elements and at least one tube;

a barrel having a muzzle and a breech, wherein the internal functional elements and the tube are physically adapted to receive the barrel, the muzzle thereof disposed proximal to the nose of the hull and a portion of the breech extending aft of the tail and therefore being accessible for reloading without disassembling the weaponized UUV, and further wherein the barrel is physically configured to slide partially through the hull in response to firing the projectile; and a recoil mechanism, wherein the recoil mechanism couples to the barrel and to the hull, wherein the recoil mechanism arrests movement of the barrel when a projectile is fired therefrom by transferring recoil load to the hull.

18. The weaponized UUV of claim 17, and further wherein the barrel is coaxial with a longitudinal centerline of the hull.

19. The weaponized UUV of claim 17 wherein recoil mechanism couples to the barrel by receiving external screw threads of a threaded interface that is disposed on an exterior of the barrel, enabling the barrel to be coupled to or decoupled from the recoil mechanism by rotating the barrel about the barrel's long axis in one direction or another other and without disassembling the UUV.

20. The weaponized UUV of claim 17, wherein the recoil mechanism does not begin arresting movement of the barrel until the barrel has traveled a first distance, wherein an amount of time required to travel the first distance is sufficient for the projectile to exit the barrel after being fired.

* * * * *